US006775864B2

(12) United States Patent
Cannetti

(10) Patent No.: US 6,775,864 B2
(45) Date of Patent: Aug. 17, 2004

(54) SHOWER BRUSH AND MASSAGER

(76) Inventor: Don Cannetti, 190 Frederick Ave., Babylon Village, NY (US) 11702

( * ) Notice: Subject to any disclaimer, the term of this patent is extended or adjusted under 35 U.S.C. 154(b) by 0 days.

(21) Appl. No.: 10/196,325

(22) Filed: Jul. 15, 2002

(65) Prior Publication Data

US 2004/0073997 A1 Apr. 22, 2004

(51) Int. Cl.[7] ..... A47K 7/02
(52) U.S. Cl. ..... 4/606; 15/21.1
(58) Field of Search ..... 4/606; 15/160, 15/21.1

(56) References Cited

U.S. PATENT DOCUMENTS 4,151,623 A * 5/1979 Steere ..... 4/606 X
5,345,640 A * 9/1994 Goss ..... 4/606 X
5,561,869 A * 10/1996 Sarel ..... 4/606

* cited by examiner

*Primary Examiner*—Robert M. Fetsuga
(74) *Attorney, Agent, or Firm*—Thomas A. O'Rourke; Bodner & O'Rourke

(57) ABSTRACT

The present invention is directed to a shower and bath appliance that provides improved cleansing as well as massaging properties. The appliance for cleansing and massaging has a housing with an impeller rotatably mounter within the housing. The housing is adapted to receive water from a shower pipe or other water source. The impeller is rotated by the flow of water from the water source. The motion of impeller rotates one or more brushes mounted on the impeller. In addition, the water flows from the impeller through the brushes as they rotate.

16 Claims, 7 Drawing Sheets

A-A

B-B

SHOWER BRUSH AND MASSAGER

FIELD OF THE INVENTION

The present invention relates to the field of shower appliances to aid and assist users who no longer have a full range of motion in their arms.

BACKGROUND OF THE INVENTION

Showering is a daily activity for most people. Most body parts are able to be cleaned easily, because they are within the reach of the showering person. However, one body part that has been traditionally difficult to reach, and thus, to wash, is the back. Specifically, the upper back between the shoulder blades has been the most difficult spot to reach. Also, people may not be able to reach this portion of the upper back, so they run soapy water over the area or lightly wash it with a soapy towel. However, neither of these methods provides a deep cleaning action like that done to the rest of the body.

Many devices have been developed to remedy this problem. Most common is the use of a hand-held back washer, which is usually a brush on the end of a stick. This device, however, is insufficient to provide a thorough cleaning of the back because it is manually operated. The angle that the device must be held at only allows for a light cleansing of the back. Another method of cleaning the back has involved the use of a detachable showerhead. Though the showerhead can be aimed directly at the back and sufficient water pressure applied, the person in the shower is still presented with the problem of applying soap to the region. Thus, the detachable showerhead only solves half of the problem.

As the population ages greater numbers of people are not as able to move their arms and legs as they once did. This becomes problem in a number of different activities that are encountered in day to day living. Household chores are no longer easily performed because of for example, arthritis, and other maladies of the joints and muscles. One particular problem that is encountered is in the bathroom. Where the bather could previously stretch or swivel around to reach his or her back, the stiffening of the joints makes this more difficult if not impossible for many older persons. Thus, in order for the older bather to wash the back becomes more difficult and the bather must either forego cleaning that area or rely on a third party to assist. Since many of our older citizens live alone relying on a third party becomes a problem. This problem is encountered not only by the older members of society but can also be a problem for younger people as well. As a result, there is a need for device that will enable a bather particularly an older bather to reach and clean the entire body area conveniently and thoroughly.

In addition, to the issue of cleaning hard to reach places, many people seek to employ the therapeutic properties of a massager to relax tense muscles. While there have been devices available that provide a shower massage these products have their limitation. For example, there are many types of massagers on the market. In one instance, the shower head is removed and replaced with another head that permits the water pattern to be adjusted. The advertising for these products claims that they act as a massager. Another similar device is installed in the same way, i.e., removing the old shower head, but these other devices have a hose connected thereto so that the shower massaging device can be removed from its stand and used to apply the water to a number of different areas of the body. While these shower head on a hose devices are an improvement over the other types of shower heads, the massaging and cleansing ability of these devices is limited. For example, there devices rely solely on the pressure of the flowing water to dislodge dirt and grime. While the pressure of flowing water is satisfactory for some types of surface dirt, this approach will not always remove more difficult dirt and grime. The massaging ability of these devices is also limited. Most of the shower massagers that are commercially available also employ the pressure of water. The shower head is provided with an adjustable face that can change the flow pattern as desired. Thus in one instance the user may want a fine spray. In others a more forceful flow. These shower heads also can be adjusted so that the water is emitted in a pulsing action. While the action of the flowing water can be beneficial, the massaging properties of these shower heads are limited. As a result, there is a need for an improved shower device that provides improved cleansing as well as an increased ability to massage the user.

OBJECTS OF THE INVENTION

It is an object of the invention to provide a shower attachment that has significant cleansing properties.

It is also an object of the present invention to provide a shower attachment that has the ability to provide a more complete massage than has heretofore been available.

It is an object of the invention to provide a shower attachment that can be easily installed on to an existing showerhead set up.

It is a further object of the invention to provide an easily installable apparatus for applying cleansing and a massage in a variety of locations in a bath or shower or elsewhere.

It is a still further object of the invention to provide an improved shower massaging device.

It is another object of the invention to provide an improved cleansing device.

It is an object of the invention to provide a shower device that permits the user to reach locations on the body that are usually difficult to reach by the prior art devices.

It is a further object of the present invention to provide a water pressured scrubbing device mounted in a shower stall or bathtub for cleaning user's backs.

It is another object of the invention to provide a device that can be connected to a main shower head and run either alternately or in conjunction with a showerhead or brush.

It is a still further object of the invention to provide a scrubbing device that can be easily and cheaply maintained by providing for low cost replacement brushes.

SUMMARY OF THE INVENTION

The present invention is directed to a shower and bath appliance that provides improved cleansing as well as massaging properties. The appliance of the present invention has a housing that is adapted to be connected to a shower head pipe that extends from the wall of the bath or shower. The housing is connected to one end of a length of flexible hosing. The other end of the hosing is connected to the shower head pipe at its threaded end. The housing has a head that is provided with a rotating head portion that is driven by the flow of water through the housing. The head portion is provided with a plurality of exit holes for evacuation of the water from its head. The head portion is also provided with a plurality of bristles. In one embodiment, the bristles rotate as the head rotates. In another embodiment, the bristles rotate independently of the head. Depending on the force of the water flow, the rotating bristles provide the user with a scrubbing action as well as a massaging action. The housing can also have a hand grip section to permit the housing to be conveniently carried. A longer housing or hand grip section will permit the user to access a greater area of the users body surface. The appliance of the present invention can be stored when not being carried on a hook member or clip extending from the shower head pipe. The rotation of the bristles provides sufficient force to readily remove dirt and grime in conjunction with the appropriate soap or detergent. In addition, the bristles provide a sensory experience to the user. Depending on the speed of rotation of the head portion and the types of bristles the upper layer of dead skin can be gently abraded. The bristles can also provide a massage by their rotating motion as well. In a preferred embodiment, the head portion can be removable and interchangeable. This will permit the user to change the configuration of the bristles, their stiffness as well as the quantity of bristles on the head. Thus a variety of cleansing and sensory experiences can be achieved by the user.

In another embodiment one or more of the appliances of the present invention can be positioned along the a bar on a wall of the bath or shower. Many baths and showers have a handhold on the wall to prevent slipping. For example, these showers and baths will usually have at least 2 handholds on the shower walls. These hand holds can be vertical, horizontal or some angle in between. The appliance of the present invention can appended to the hand hold by a clip or a clamp. If a plurality of appliances are present the user will thereby multiply the action of a single appliance and cover a greater area of the body. One of the advantages of having a plurality of appliances on a single vertical bar is that the user merely has to rotate to get the benefit of the rotating brushes over a significant length of the body. In another embodiment, there can be a plurality of hand holds for example one on each wall of the shower or bath. In this manner the user can receive the benefits of the present invention on two sides of the body at once.

DETAILED DESCRIPTION OF INVENTION

Figure 1:
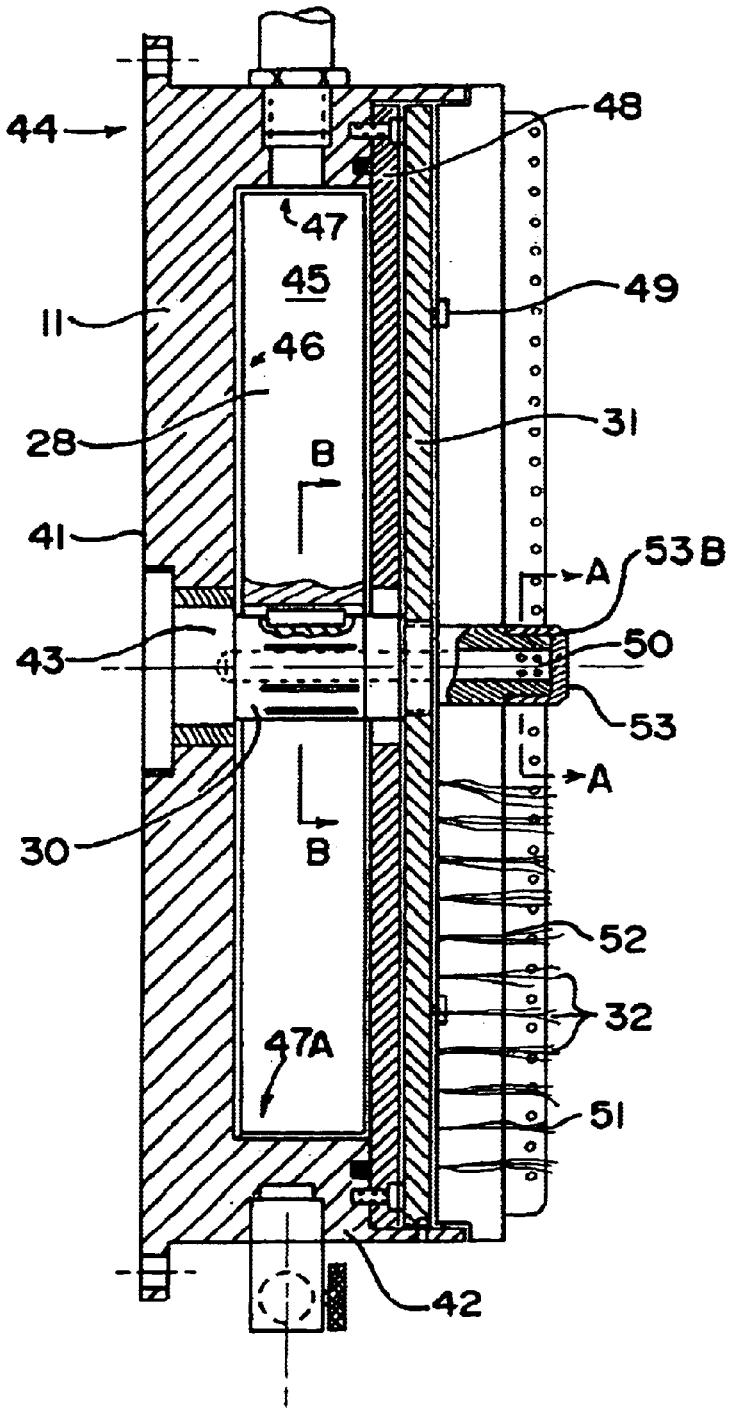
FIG. 1 is a cross sectional view of the apparatus of the present invention.
Figure 1A:
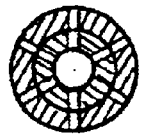
FIG. 1A is a cross sectional view of the apparatus shown in FIG. 1 along the line A—A.
Figure 1B:
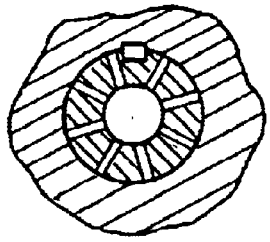
FIG. 1B is a cross sectional view of the apparatus shown in FIG. 1 along the line B—B.
Figure 2:
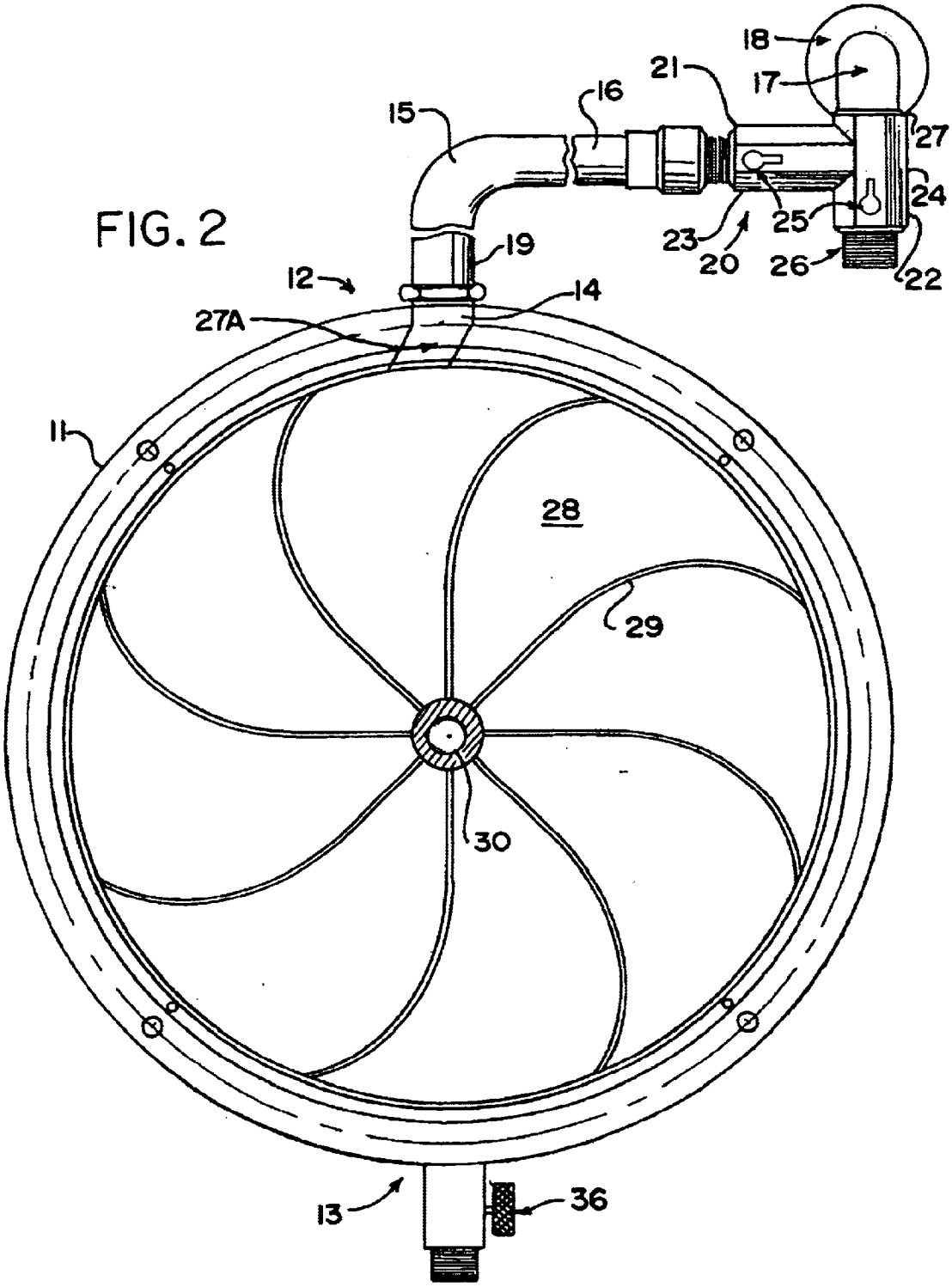
FIG. 2 is front view of the apparatus of FIG. 1 with the brush base removed.

The apparatus 10 of the present invention has a housing 11 that may be generally round or may be oblong. No matter what the shape, the housing has a first end portion 12 and a second end portion 13. One end portion 12 of the apparatus has a connection means 14, usually threaded, for securing the housing to a length of hose 15. The upper portion 16 of the length of hose is attached to an existing shower pipe 17 that is typically provided with a plate 18 to hide any rough edges in the tile. The second end portion 13 is preferably provided with a pressure release valve 36 that alleviates water pressure, provides a means of emptying the apparatus of any water remaining therein, and controls the speed of rotation of the brushes.

In another embodiment of the invention the housing 11 may be directly attached to the existing shower pipe 17 by a connection such as a threaded connection. In a second embodiment, the existing shower pipe 17 has one end 16 of the hose directly connected to the threads on the existing shower pipe. The other end 19 of the hose 15 is connected to the housing 11. In a still further embodiment, the shower pipe 17 has a "T" valve 20 with valve diverters 21 and 22. A hose is connected to one orifice of valve diverter 21 of the "T" valve and directed to the water supply intake end portion 12 of the housing. The other orifice of valve diverter 22 of the "T" valve allows for attachment of any hand held shower brush or shower head (not shown). The remaining end 27 of the "T" valve is connected to the shower pipe 17.

Preferably both valve portions 23 and 24 on the double valve diverter are equipped with control means, which can take the form of on-off spigots 25 and 26 to regulate the direction of flow of the water through the "T" valve 20. If there are no on-off spigots 25 and 26 present, water will flow into both valves constantly, thus reducing the water pressure at the output orifices of the valve diverters 21 and 22 on the "T" valve.

The hose 15 running from one valve to the water supply intake of the device may be a rubber hose, PVC piping, or any water supply means. The hose 15 may be of any length desired. Standard four foot flexible hose is recommended, as it is commonly accepted by those skilled in the art. It will be appreciated that a longer length of hosing may be more suitable for use with children due to their small stature. Shorter lengths of hosing can be used for adults, if desired.

The hose 15 can be connected to the water supply intake 12 of the housing 11 by any one of a plurality of watertight connections, such as threads, clamps, etc. If a threaded connection is to be used, then the top of the water supply intake end portion 12 on the housing 11 should also be threaded. One type of hose 15 that is particularly suitable for the present invention is a flexible hose with a female member at each end. These types of flexible hoses have reached general acceptance in the art for making water connections between plumbing fixtures and water intake valves in residences and the like because of their strength and ease of use. Where each end of the flexible hose has a female member, then the water supply intake 12 of the housing 11 and at least one end of the "T" valve should be a male member. However, it will be appreciated that any one of a number of snap type fittings can be used in lieu of a threaded connection. Similarly, the hose 15 may have male members at one or both ends thereof that connect to a female end on the water supply intake 12 on the housing 11 and/or a traditional shower head or shower attachment.

Within the housing 11 is an intake head 27A that assists in directing the water flow from the hose 15 to a generally circular impeller 28. The intake head is preferably angled to cause the water flow to impinge on the blades 29 of the impeller. The angle of the intake head and the water pressure causes the impeller to rotate. In one embodiment, the impeller 28 may be a series of blades rotatably mounted in the housing. In another embodiment the impeller may be a generally flat disc, with a series of recesses for receiving water which causes the disk to rotate. In a still further embodiment, there can be a flat disk with a plurality of blades extending therefrom. The impeller whether blades or a disk, is rotatably connected to the housing 11 of the device by means of a shaft 30. It is understood that the impeller may be circular, triangular, or a paddlewheel design. The impeller can be replaced by any means that will rotate and direct water into the hollow shaft water supply 50. Also, the plastic housing 11 may be square or not there at all. There need only be back surface to the housing that can adhere to a surface usually flat by some means and provide an attachment for the hollow shaft water supply.

In one embodiment, a circular plate 31 is immovably attached to the shaft 30 and turns in conjunction with the rotation of the impeller 28. On top of the circular plate 31 may be a plurality of brush members 32. The brush members 32 may be secured to the circular plate. Preferably, the interchangeable brushes are releasably locked into place on the circular plate 31. The circular plate 31 is preferably provided with a plurality of orifices (not shown) for water to flow through the circular plate. Both series of orifices may be present to permit the water to flow from the impeller to the outside of the housing. The size of the orifices 33 and 34 can vary depending on the water flow that is desired. Similarly, the pattern of the orifices can similarly be varied to provide any water flow arrangement that is desired.

The brush members 32 may be secured to the circular plate 31 such that the orifices the brush members 32 ass through are not entirely sealed and water may flow therethrough. The filaments of the brush may be secured to the circular plate 31 by any suitable means so that they do not become separated from the circular plate. The circular plate 3 can be divided into a plurality of sections and have one or more orifices and wherein each of the sections of the plate are provided with one or more brushes and each of said sections are separated by a shallow shaft water spray 52 for directing from the impeller 28 to a surface. As with the case of the water flow orifices 33 and 34, the brush filament orifices 35 may be different sizes to accommodate different sized groupings of filaments.

As seen in FIG. 1 there is a housing 11 that has a rear portion 41 and a sidewall 42. At generally a center portion of the interior surface 43 of the rear portion there is an axle or shaft 30. The shaft 30 can be molded from the same material as the housing or it may be a separate member that is secured to the housing. The outer surface of the rear portion 41 of the housing 11 may be provided with an adhesive material 44. This adhesive material may be in the form of a ring generally around the circumference or outer edge of the rear portion of the housing. The adhesive material may be used to secure the device of the present invention to a suitable surface. There may also be screw knock-outs on the rim of the plastic casing to allow for attachment to the wall by screws.

The impeller 28 resides in a reservoir or chamber 45. The chamber may have a rear wall 46 and one or more sidewalls 47 and 47A. In one embodiment, the side of the chamber 45 opposite the rearwall 46 may be covered by a sealing plate 48 to seal the impeller. The plate will usually be generally circular but other configurations are possible. The sealing plate 48 is usually stationary but it could, if desired rotate as the impeller rotates. The sealing plate may contain orifices to allow water to escape, or may have a water-tight seal with the impeller to maintain the flow of water into the hollow shaft water supply 50. The sealing plate 48 may be connected to the impeller 28 preferably by screws positioned on various points around the plate or other suitable means.

The water fed into the impeller is forced into a hollow shaft water supply 50 at the center of the impeller. The hollow shaft water supply 50 can begin at the center of the impeller 28 and run through the sealing plate 48, the circular plate 31, the base of the brushes 51 and the shallow shaft water spray 52.

Figure 3:
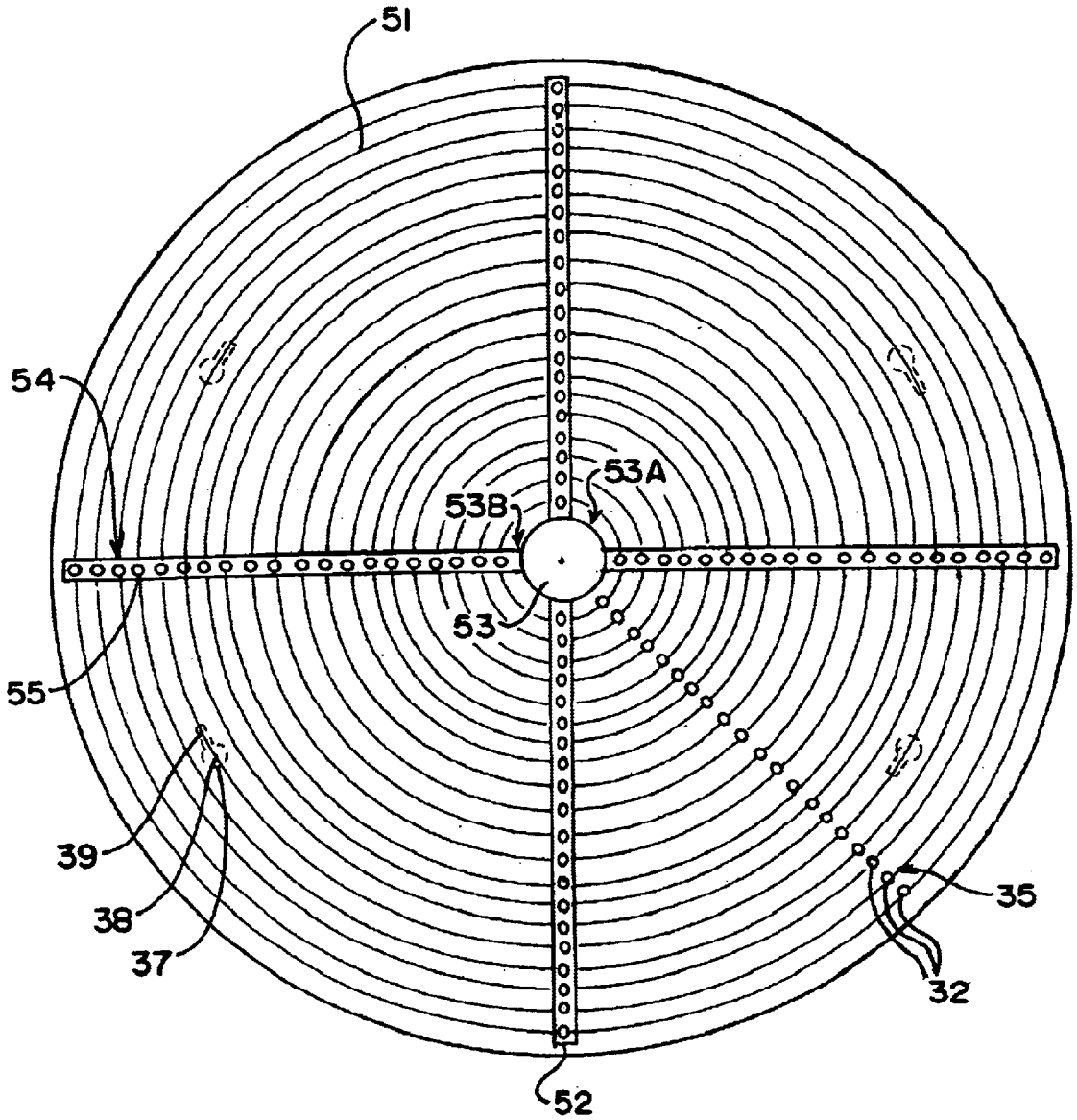
FIG. 3 is a front view of the face of the brush plate.
Figure 4:
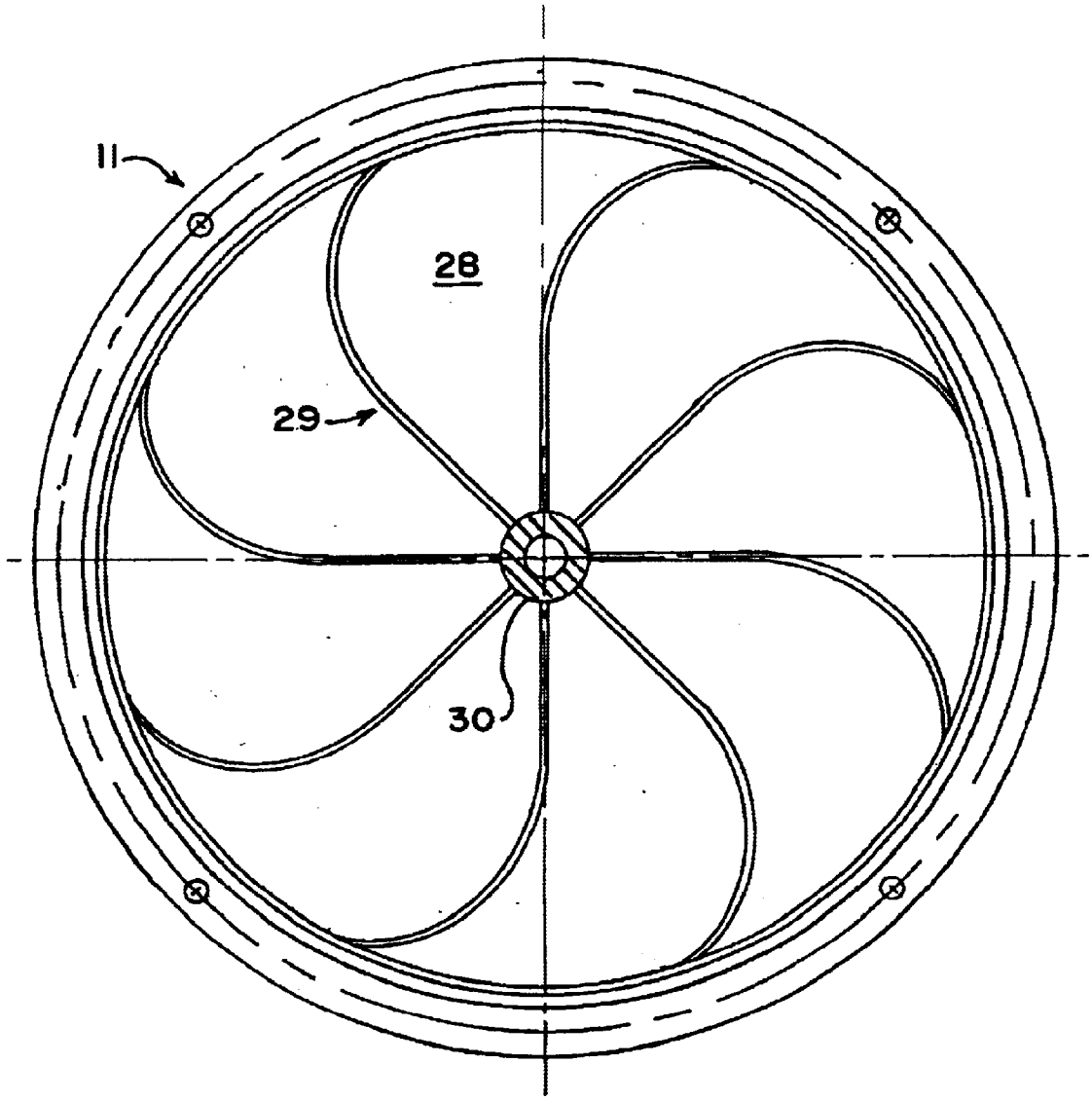
FIG. 4 is a front view of the impeller.

In the embodiment shown in FIG. 3, along the hollow shaft water supply 50, between the base of the brush and the end knob or cap 53, is a shallow shaft water spray 52. The shallow shaft water spray has a center attachment 53A that may have a plurality of outlets 53B. Each outlet has a length member 54 that is lined with small holes 55 on its surfaces that faces outward. Water flows through the hollow shaft water supply 50 into the shallow shaft water spray 52, which feeds water into a length member 54 that sprays water into the brush. The length members 54 can extend to outer portion of the brush if desired.

Figure 5:
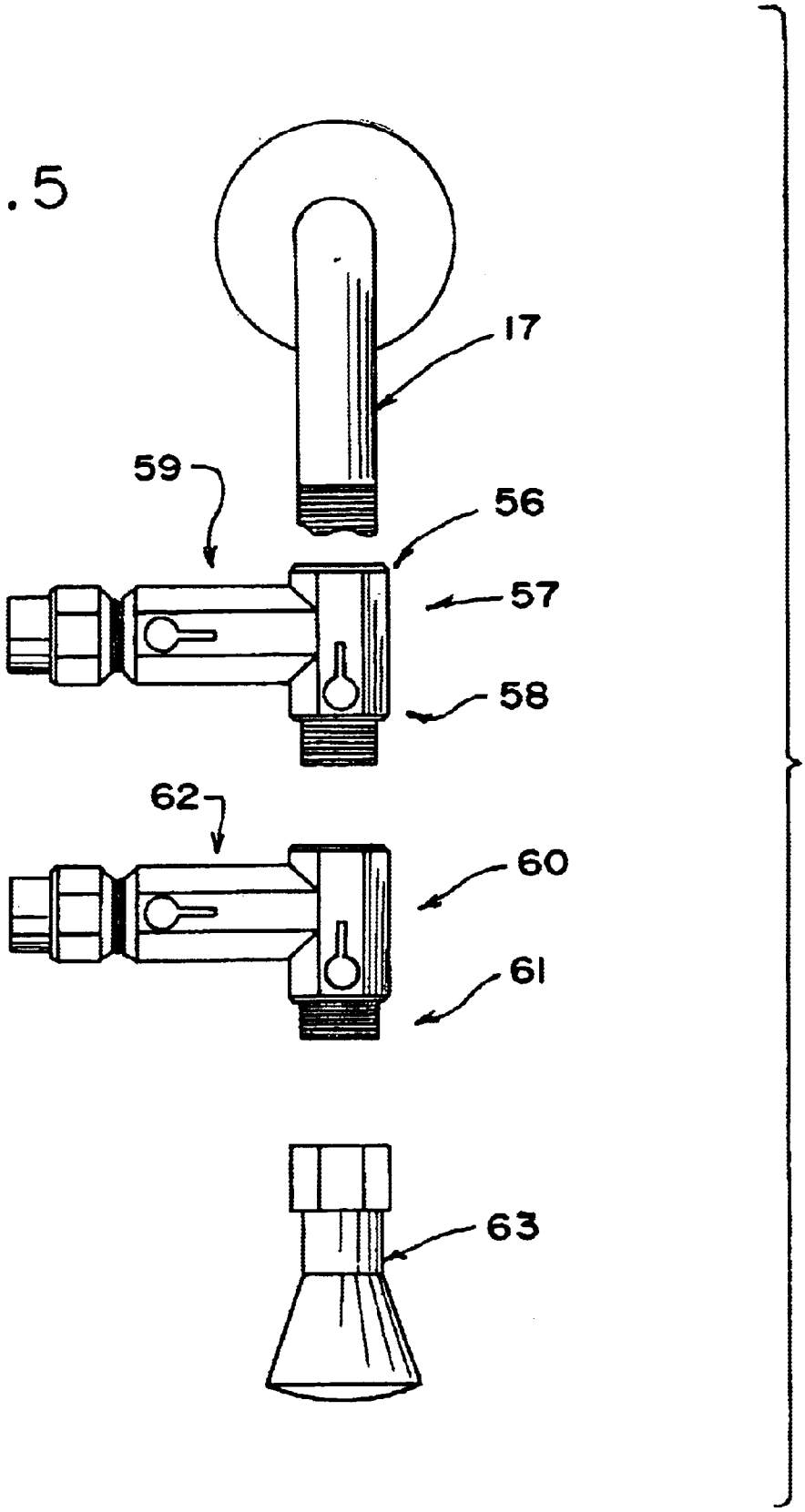
FIG. 5 is a front view of a dual "T" valve embodiment of the present apparatus.

FIG. 5 shows how a user may use more than one "T" valve with the present device. The first "T" valve 57 has a pipe connection 56 which is attached to shower pipe 17. The first "T" valve 57 also has valve diverters 58 and 59. A second "T" valve 60 can be attached to valve diverter 58. The second "T" valve 60 has valve diverters 61 and 62. The "T" valve directs the flow of water from the shower pipe to the housing and the first and second "T" valves can be connected in a series. A showerhead 63 can be attached to valve 61, while the present invention and a handheld showerhead may be attached to either valve diverter 58 or valve diverter 62.

Figure 6:
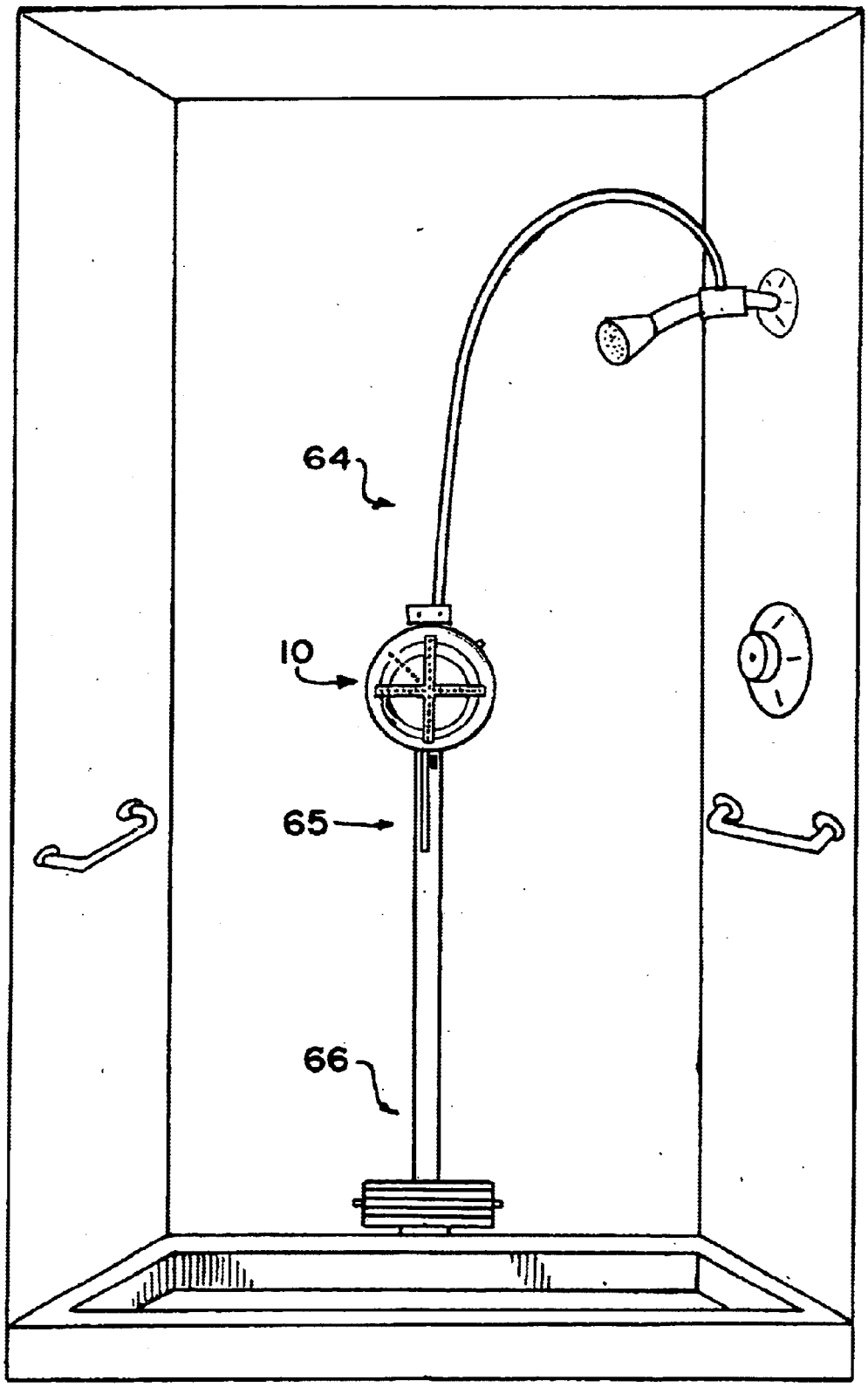
FIG. 6 is a front view of the apparatus in a shower stall.
Figure 7:
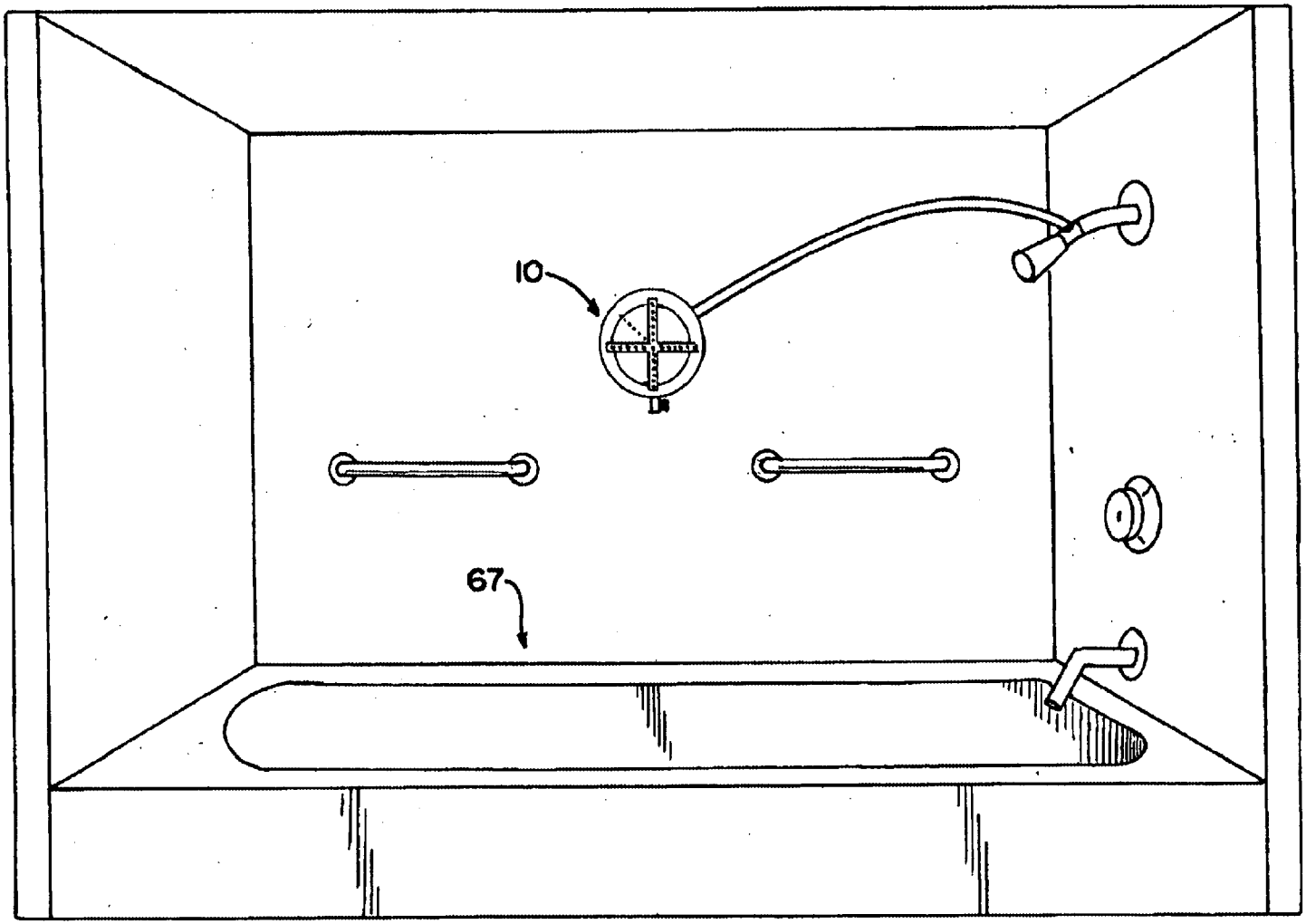
FIG. 7 is a front view of a second embodiment of the apparatus in a bathtub.

FIG. 6 depicts the present invention in a shower stall. In this embodiment, the apparatus 10 is not attached to the shower wall 64. Rather, the apparatus 10 rides along a bar or pole member 65 which is generally in a vertical direction. Although, the apparatus may be equipped to ride along a horizontal member. The pole member 65 may be fixed to the shower wall or weighted at its lower end 66 to give it stability. FIG. 7 shows the apparatus 10 adhered to a wall over a bathtub 67.

I claim:

1. An apparatus for cleaning and massaging a user adapted to attach to a shower pipe comprising a housing, said housing having an impeller rotatably mounted thereon, said housing being adapted to receive said shower pipe, said impeller being rotated by the flow of water from the shower pipe, said impeller rotating one or more brushes mounted thereon, said water flowing from said impeller through the brushes as they rotate, said brushes being mounted on a plate, said plate having one or more orifices therein for water to flow through after said water rotates the impeller, said plate is divided into a plurality of sections and wherein each of the sections of the plate are provided with one or more brushes and each of said sections are separated by a shallow shaft water spray for directing water from the impeller to a surface.

2. The apparatus according to claim 1, wherein said housing has a pressure release valve for adjusting the rotation of the impeller.

3. The apparatus according to claim 2 wherein a hose connects the housing to a "T" valve.

4. The apparatus according to claim 2 wherein there are control means for adjusting the flow of water on said "T" valve.

5. The apparatus according to claim 1 wherein said housing is adapted to be mounted to said shower pipe.

6. The apparatus according to claim 1 wherein a "T" valve directs the flow of water from said shower pipe to said housing.

7. The apparatus according to claim 6 wherein said housing is connected to said shower pipe by means of a hose.

8. The apparatus according to claim 6 wherein there are a first and second "T" valves, said first and second "T" valves being connected in series.

9. The apparatus according to claim 1, wherein said impeller resides in a chamber in said housing and wherein said impeller directs water through an axle so that the water may pass through a shallow shaft water spray.

10. The apparatus according to claim 1 wherein said housing is adapted to be attached to a wail surface.

11. The apparatus according to claim 1 wherein said housing is adapted to be attached to a stationary bar on a wall.

12. The apparatus according to claim 1 wherein there is a non rotating plate between said impeller and said rotating plate.

13. The apparatus according to claim 1 wherein said non rotating plate seals the housing and water can only flow from the housing through the hollow shaft water supply mounted on a shaft.

14. An apparatus for cleaning and massaging a user adapted to attach to a shower pipe comprising a housing, said housing having an impeller rotatably mounted thereon, said housing being adapted to receive said shower pipe, said impeller being rotated by the flow of water from the shower pipe, said impeller rotating one or more brushes mounted thereon, said water flowing from said impeller through the brushes as they rotate, said brushes being mounted on a plate, said plate having one or more orifices therein for water to flow through after said water rotates the impeller, said plate is divided into a plurality of sections and wherein each of the sections of the plate are provided with one or more brushes and each of said sections are separated by a shallow shaft water spray for directing water from the impeller to a surface, said plate is divided into four quarters.

15. An apparatus for cleaning and massaging a user adapted to attach to a shower pipe comprising a housing, said housing having an impeller rotatably mounted thereon, said housing being adapted to receive said shower pipe, said impeller being rotated by the flow of water from the shower pipe, said impeller rotating a plate having one or more brushes mounted thereon, said water flowing from said impeller through the plate as the impeller rotates, said water passing from the pipe into the housing and passing into a hollow shaft water supply mounted on a shaft on which said impeller rotates said shaft having a shallow shaft water spray, said shallow shaft water spray has a center attachment that has a plurality of outlets, each of said outlets having a length member that is lined with holes on a surface facing outwardly from said impeller.

16. An apparatus for cleaning and massaging a user adapted to attach to a shower pipe comprising a housing, said housing having an impeller rotatably mounted thereon, said housing being adapted to receive said shower pipe, said impeller being rotated by the flow of water from the shower pipe, said impeller rotating a plate having one or more brushes mounted thereon, said water flowing from said impeller through the plate as impeller rotates, said water passing from the pipe into the housing and passing into a shallow shaft water supply mounted on a shaft on which said impeller rotates said shaft having a shallow shaft water spray, said shallow shaft water spray has a center attachment that has a plurality of outlets, each of said outlets having a length member that is lined with holes on a surface facing outwardly from said impeller, said length member extends to an outer portion of the rotating plate.

* * * * *